US007651087B2

(12) United States Patent
Miyashita et al.

(10) Patent No.: US 7,651,087 B2
(45) Date of Patent: Jan. 26, 2010

(54) STACKER, RECORDING DEVICE, AND LIQUID EJECTING DEVICE

(75) Inventors: Eiichi Miyashita, Okaya (JP); Sanshiro Takeshita, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 523 days.

(21) Appl. No.: 11/465,425

(22) Filed: Aug. 17, 2006

(65) Prior Publication Data

US 2007/0040887 A1 Feb. 22, 2007

(30) Foreign Application Priority Data

Aug. 19, 2005 (JP) ..... 2005-238255

(51) Int. Cl.
*B41J 2/01* (2006.01)
*B65H 1/00* (2006.01)

(52) U.S. Cl. ..... 271/163; 347/104

(58) Field of Classification Search ..... 347/104; 271/162, 163, 3.01
See application file for complete search history.

(56) References Cited

U.S. PATENT DOCUMENTS 6,814,436 B2 * 11/2004 Anami et al. ..... 347/104
6,854,843 B2 * 2/2005 Anami et al. ..... 347/104
6,871,949 B2 * 3/2005 Nakano et al. ..... 347/104
7,111,934 B2 * 9/2006 Okuda et al. ..... 347/104
7,137,698 B2 * 11/2006 Miyake et al. ..... 347/104
7,401,879 B2 * 7/2008 Isono et al. ..... 347/16
2004/0041860 A1 * 3/2004 Takahashi et al. ..... 347/8
2005/0225594 A1 * 10/2005 Isono et al. ..... 347/37
2005/0225622 A1 * 10/2005 Anami et al. ..... 347/104
2006/0082633 A1 * 4/2006 Kagami et al. ..... 347/108
2006/0119694 A1 * 6/2006 Takeshita ..... 347/164
2006/0170750 A1 * 8/2006 Takeshita et al. ..... 347/104
2006/0181566 A1 * 8/2006 Miyashita et al. ..... 347/20
2007/0058024 A1 * 3/2007 Miyake et al. ..... 347/104
2007/0058025 A1 * 3/2007 Miyake et al. ..... 347/104
2007/0058026 A1 * 3/2007 Miyake et al. ..... 347/104

FOREIGN PATENT DOCUMENTS

JP 2004-130774 A 4/2004

* cited by examiner

*Primary Examiner*—Kaitlin S Joerger
(74) *Attorney, Agent, or Firm*—Workman Nydegger

(57) ABSTRACT

A recording device including a linear transporting path for transporting a plate-shaped body, comprising a stacker disposed downstream from an ejecting unit, the stacker being capable of switching between a first position where the stacker forms a portion of the linear transporting path and a second position which is positioned below the first position and where the stacker stacks the recording medium ejected by the ejecting unit, wherein the stacker includes a pair of guide ribs which supports the plate-shaped body at the first position and guides both side ends of the plate-shaped body positioned at the first position, and which to support the ejected recording medium at the second position.

6 Claims, 8 Drawing Sheets

STACKER, RECORDING DEVICE, AND LIQUID EJECTING DEVICE

BACKGROUND

1. Technical Field

The present invention relates to a recorded medium stacker disposed at a downstream side of an ejecting unit for ejecting a recording medium in a recording device including a linear transporting path for transporting a plate-shaped body, and a recording device including the same. The present invention also relates to a liquid ejecting device.

The liquid injecting device is used for an ink jet recording head, and is not limited to a recording device such as a printer, a copier and a facsimile for discharging ink from a recording head to perform record on a recording medium. That is, the liquid ejecting device includes a device for ejecting liquid corresponding to the ink from a liquid injecting head corresponding to an ink jet recording head onto an injected medium corresponding to the recording medium to attach the liquid onto the injected medium.

The liquid ejecting head may be a color material ejecting head used for manufacturing a color filter of a liquid crystal display or the like, a electrode material (conductive paste) ejecting head used for forming an electrode of an organic electroluminescence display, a field emission display (FED) or the like, a bioorganic substance ejecting head used for manufacturing a bio chip, and a sample ejecting head as a precise pipette, in addition to the above-described recording head.

2. Related Art

In an ink jet printer which is an example of a recording device or a liquid ejecting device, an optical disc such as CD-R or DVD is used as a recording medium and an ink drop is directly discharged on a label side of the recording medium to perform record. In such an ink jet printer, the optical disc is set in a tray having a plate shape (plate-shaped body) and transported along a linear transporting path (in a sub scanning direction) in the ink jet printer in a state that the optical disc is set in the tray, and ink jet record is performed on the label side.

The tray is manually fed into the printer while being supported by a guide disposed at the front side of the ink jet printer. JP-A-2004-130774 discloses a recording device in which a stacker provided at the front side of the device can be switched between two positions. That is, in a first position, a linear tray transporting path is formed in order to transport the tray and, in a second position, a stacker for stacking a general print sheet is formed.

However, in the first position, when a pair of guide ribs for guiding the both side ends of the tray is provided on the stacker in order to define the position of the tray in a main scanning direction, any one of the guide ribs overlaps the ejection position of the print sheet ejected at the second position, that is, the ejected print sheet must be positioned at a position supported from the bottom.

In this case, the ejected print sheet is stack on the guide rib to be slanted (in a sheet width direction) and interfered with a print sheet which is subsequently ejected. Accordingly, the ejection of the print sheet or the orderly lamination of the print sheets may be interrupted. The laminated print sheets may obliquely collapse.

SUMMARY

Accordingly, an advantage of the invention is to allow ejected recording sheets to be appropriately laminated in a recording medium stacker which can be switched between two positions and include a guide rib for guiding a tray.

According to a first aspect of the invention, there is provided a stacker in a transporting device including a linear transporting path for transporting a first transport medium, wherein the stacker is disposed at a downstream side of an ejecting unit for ejecting a second transport medium, and can be switched between a first position that forms the linear transporting path and a second position which is positioned below the first position and stacks the second transport medium ejected by the ejecting unit, wherein the stacker includes a pair of guide ribs which supports the first transport medium at the first position and guides the both side ends of the first transport medium positioned at the first position to a support surface for supporting the ejected second transport medium at the second position, wherein one of the pair of guide ribs is disposed at a position for supporting the ejected second transport medium from the bottom at the second position, wherein at least one support rib for supporting the ejected second transport medium from the bottom together with the guide rib is provided on the support surface, and wherein the second transport medium ejected to the stacker is supported in substantially parallel to the support surface by the guide rib and the support rib at the second position.

According to this aspect of the invention, since one of the pair of guide ribs for guiding the both side ends of the plate-shaped body that is first transport medium is disposed at a position for supporting the ejected recording medium that is second transport medium from the bottom at the second position and the support rib for substantial-horizontally supporting the ejected recording medium from the bottom together with the guide rib is also provided, the recording medium is not laminated to be slanted from the support surface of the stacker due to the existence of the guide rib. In addition, the ejection of a subsequent recording medium is not interrupted or the laminated recording mediums do not obliquely collapse. Accordingly, the ejected recording medium can be orderly laminated.

Since a gap can be formed between the support surface of the stacker and the ejected recording medium by the guide rib and the support rib, it is possible to solve a problem that the ejected recording medium is adhered to the support surface of the main stacker and thus is hard to be extracted. Particularly, a small-sized recording medium of which the front end is not protruded from the stacker when being ejected to the support surface of the stacker can be easily extracted.

According to a second aspect of the invention, in the first aspect, the guide rib and the support rib extend over an ejection direction of the recording medium on the support surface.

According to this aspect, since the guide rib and the support rib extend over the ejection direction of the recording medium on the support surface, it is possible to more surely support the recording medium ejected to the main stacker in parallel to the support surface.

According to a third aspect of the invention, in the first or second aspect, upstream ends of the guide rib and the support rib have oblique surfaces.

According to this aspect, since the upstream ends of the guide rib and the support rib have the oblique surfaces; the front end of the ejected recording medium can be smoothly ejected without being caught by the guide rib and the support rib.

According to a fourth aspect of the invention, in any one of the first to third aspects, downstream ends of the guide rib and the support rib have oblique surfaces. According to this aspect, since the downstream ends of the guide rib and the support rib have the oblique surfaces, when the sub stacker is extracted from the main stacker and sheets having a large longitudinal size are stacked, the sheets can be reasonably stacked in a natural position, without forming a step by the downstream ends of the guide rib and the support rib.

According to a fifth aspect of the invention, there is provided a recording device including a linear transporting path for transporting a plate-shaped body, comprising: a stacker is disposed at a downstream side of an ejecting unit for ejecting a recording medium, and can be switched between a first position that forms the linear transporting path and a second position which is positioned below the first position and stacks the recording medium ejected by the ejecting unit, wherein the stacker includes a pair of guide ribs which supports the plates shaped body at the first position and guides the both side ends of the plate-shaped body positioned at the first position to a support surface for supporting the ejected recording medium at the second position, wherein one of the pair of guide ribs is disposed at a position for supporting the ejected recording medium from the bottom at the second position, wherein at least one support rib for supporting the ejected recording medium from the bottom together with the guide rib is provided on the support surface, and wherein the recording medium ejected to the main stacker is supported in substantially parallel to the support surface by the guide rib and the support rib at the second position. According to this aspect, it is possible to obtain the same effects as the first to fourth aspects.

According to a sixth aspect of the invention, there is provided a liquid injecting device including a linear transporting path for transporting a first target medium, comprising: a stacker is disposed at a downstream side of an ejecting unit for ejecting a second target medium, and can be switched between a first position that forms the linear transporting path and a second position which is positioned below the first position and stacks the second target medium ejected by the ejecting unit, wherein the stacker includes a pair of guide ribs which supports the first target medium at the first position and guides the both side ends of the first target medium positioned at the first position to a support surface for supporting the ejected second target medium at the second position, wherein one of the pair of guide ribs is disposed at a position for supporting the ejected second target medium from the bottom at the second position, wherein at least one support rib for supporting the ejected second target medium from the bottom together with the guide rib is provided on the support surface, and wherein the second target medium ejected to the main stacker is supported in substantially parallel to the support surface by the guide rib and the support rib at the second position.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
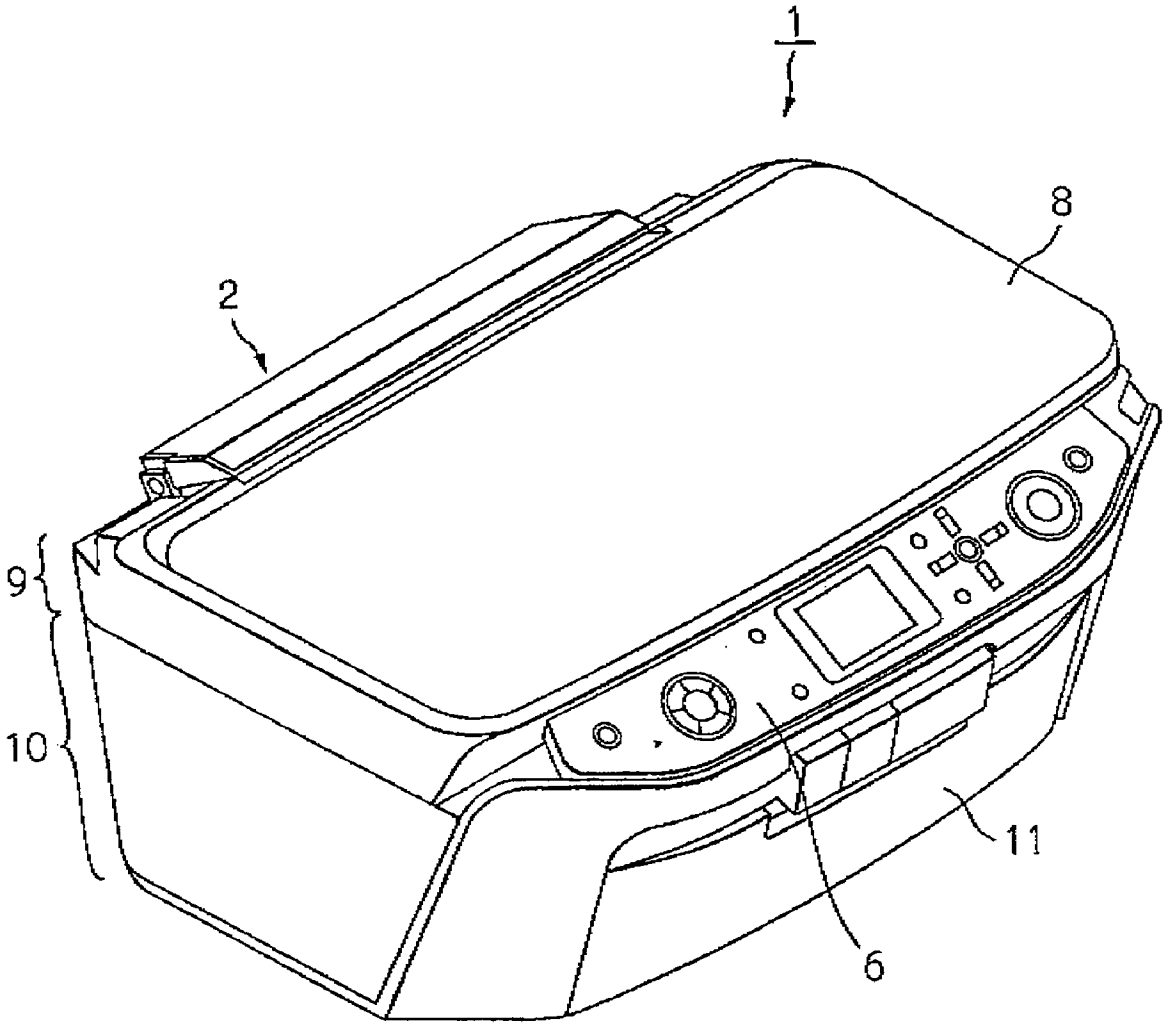
FIG. 1 is a perspective view showing an appearance of a printer according to an embodiment of the invention.
Figure 2:
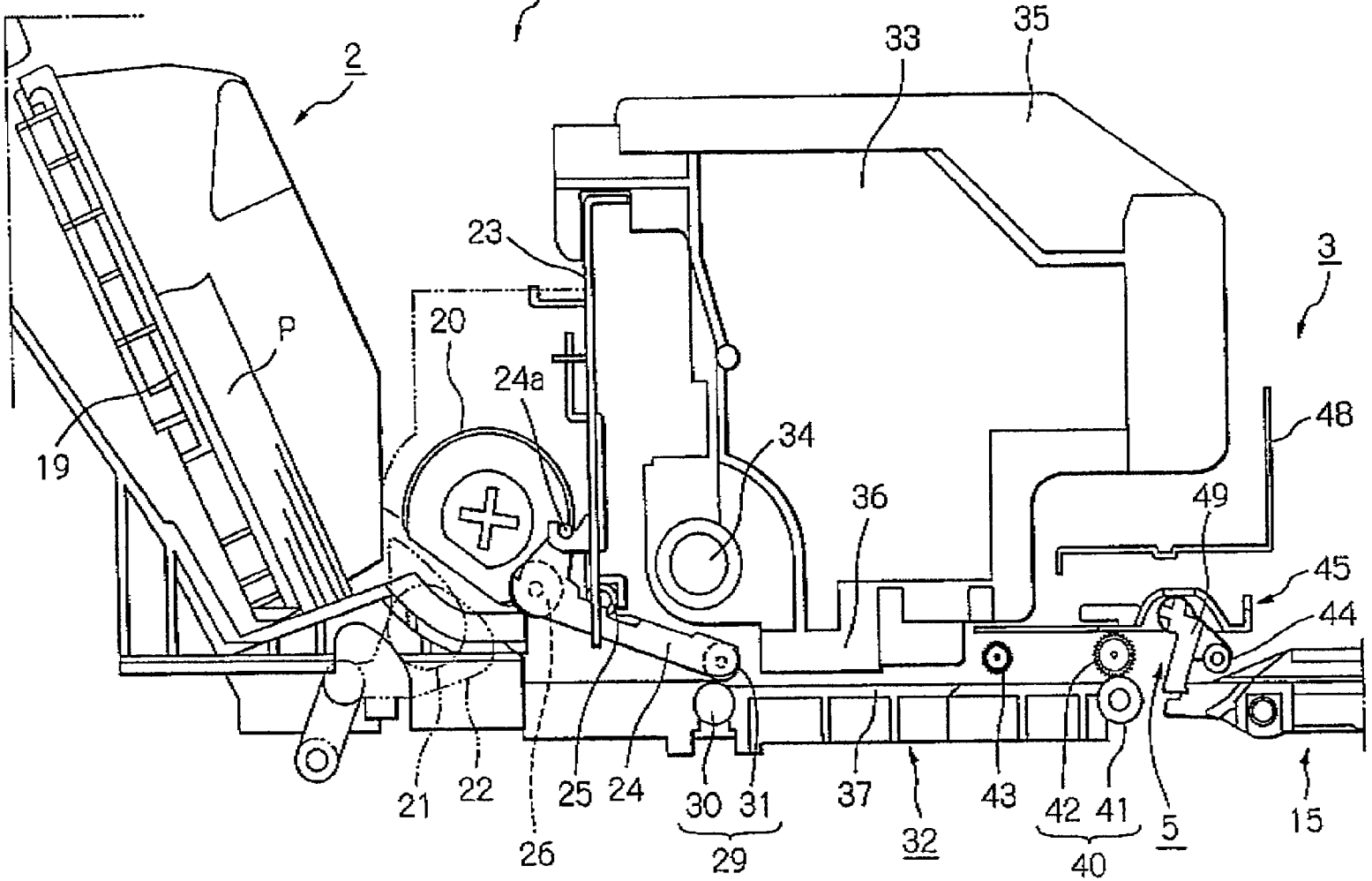
FIG. 2 is a side cross-sectional view showing the printer according to the embodiment of the invention.
Figure 3:
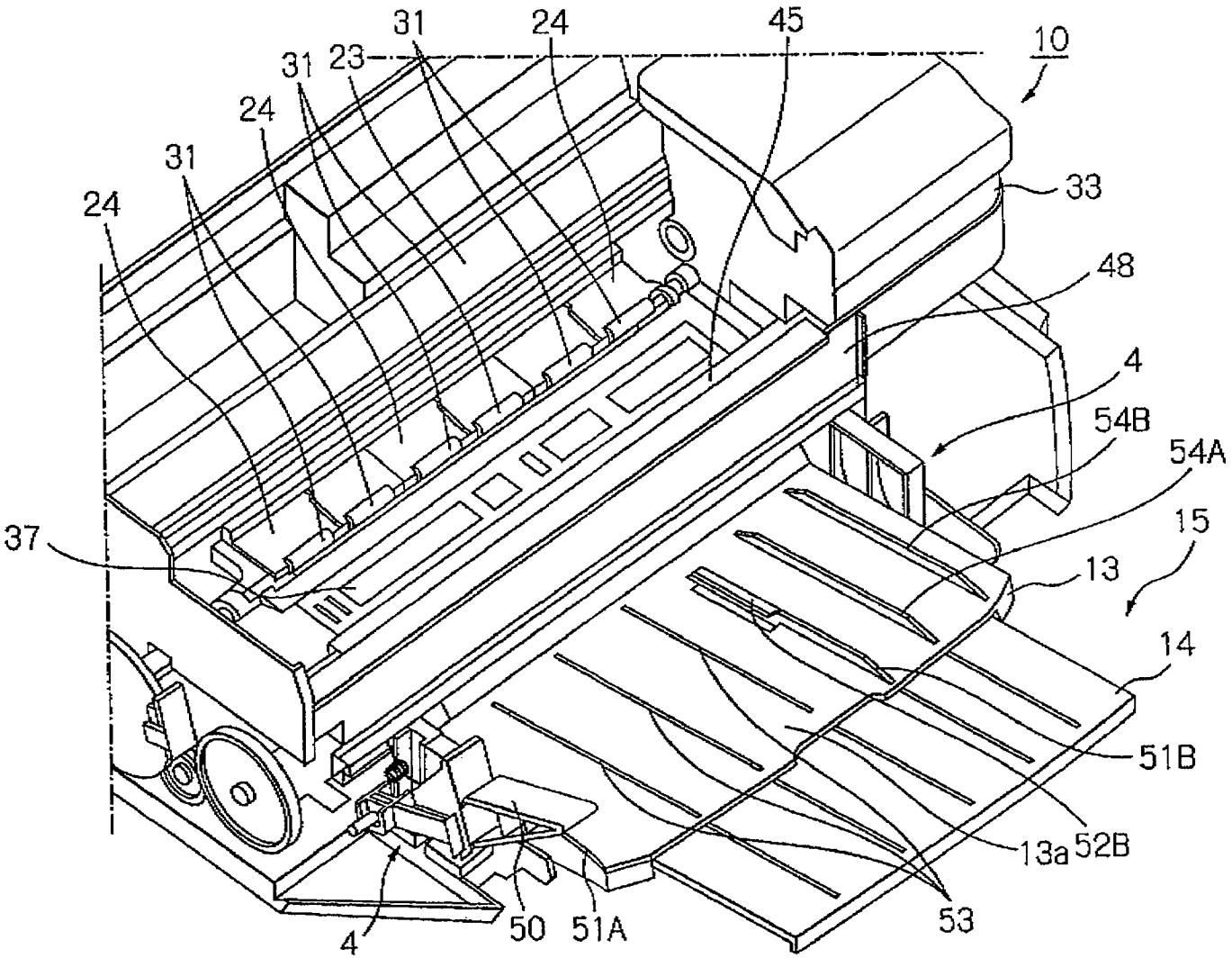
FIG. 3 is a perspective view showing an appearance of a main body of the printer according to the embodiment of the invention.
Figure 4A:
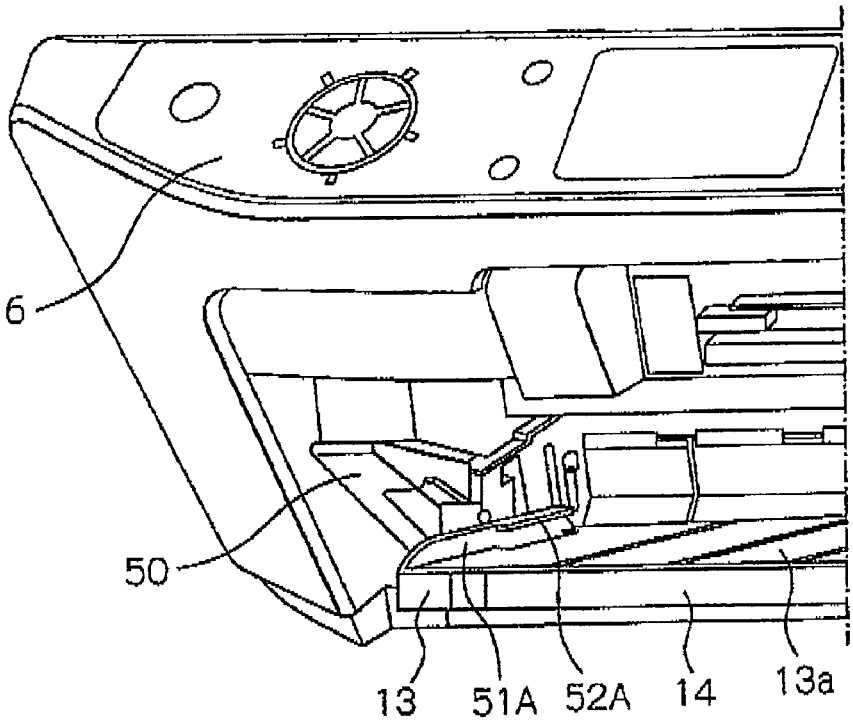
FIGS. 4A and 4B is a perspective view showing an appearance of entire portions of the printer according to the embodiment of the invention.
Figure 4B:
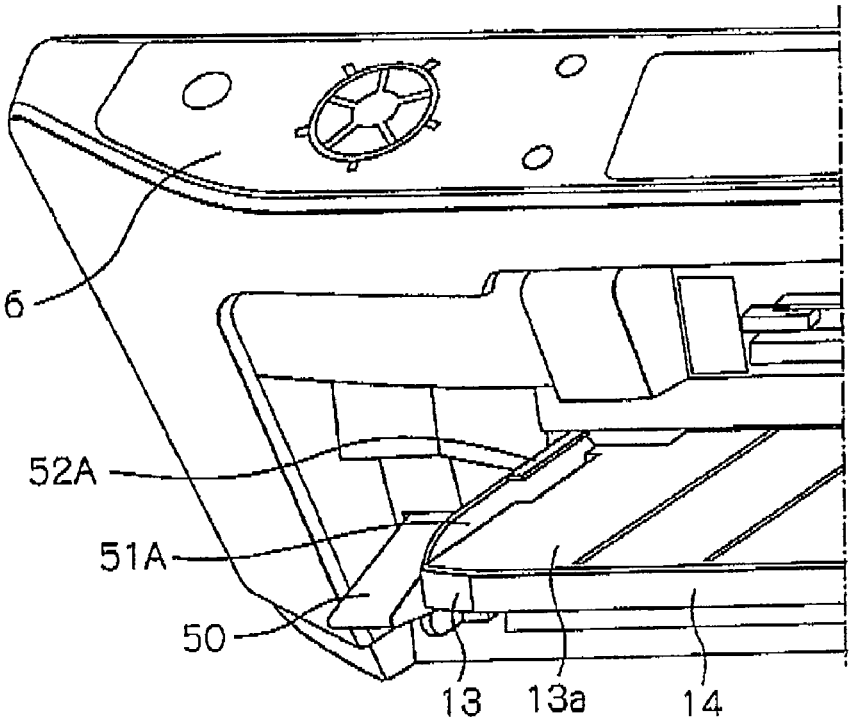
Figure 5:
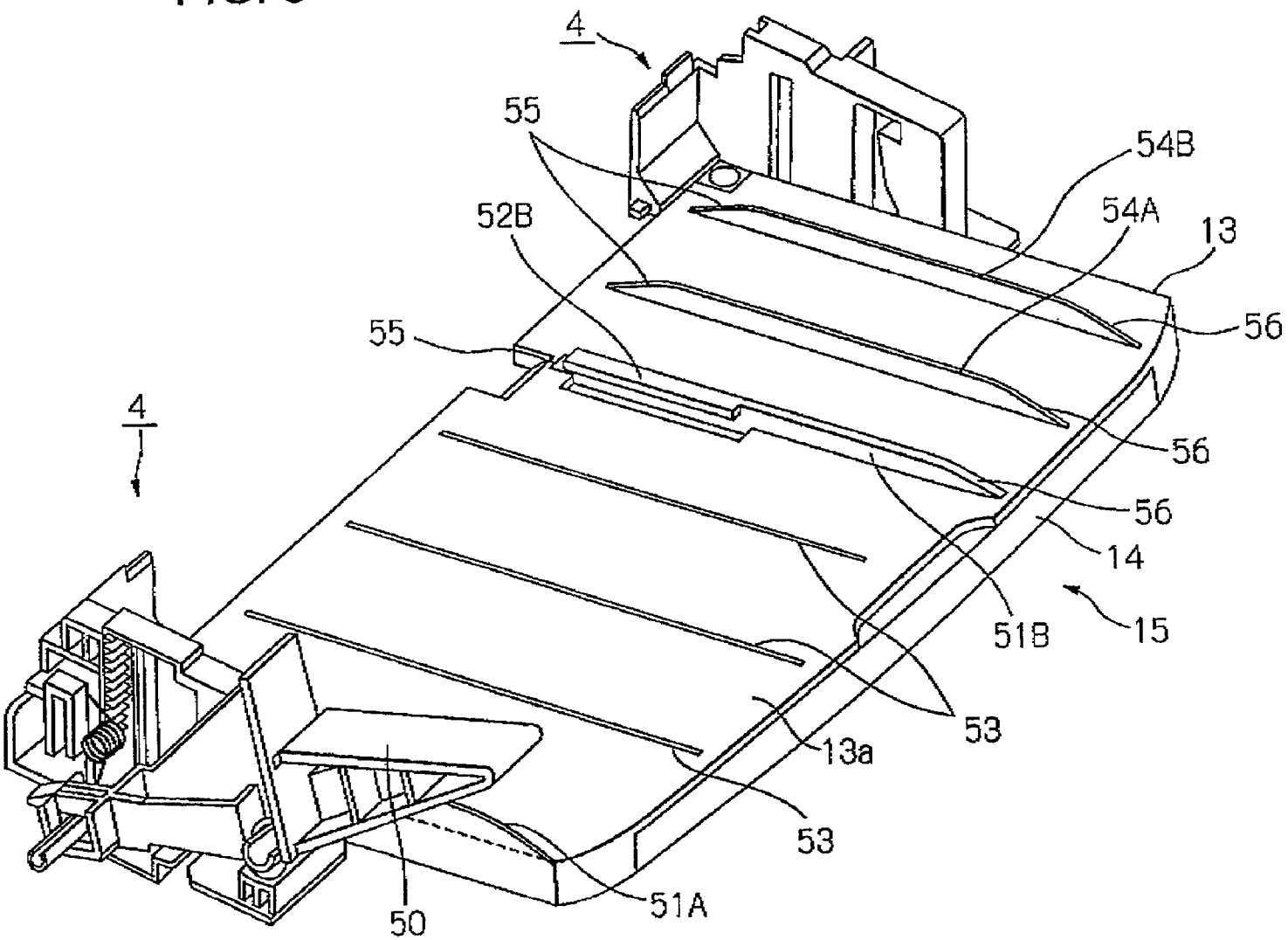
FIG. 5 is a perspective view of a stacker according to an embodiment of the invention.
Figure 6:
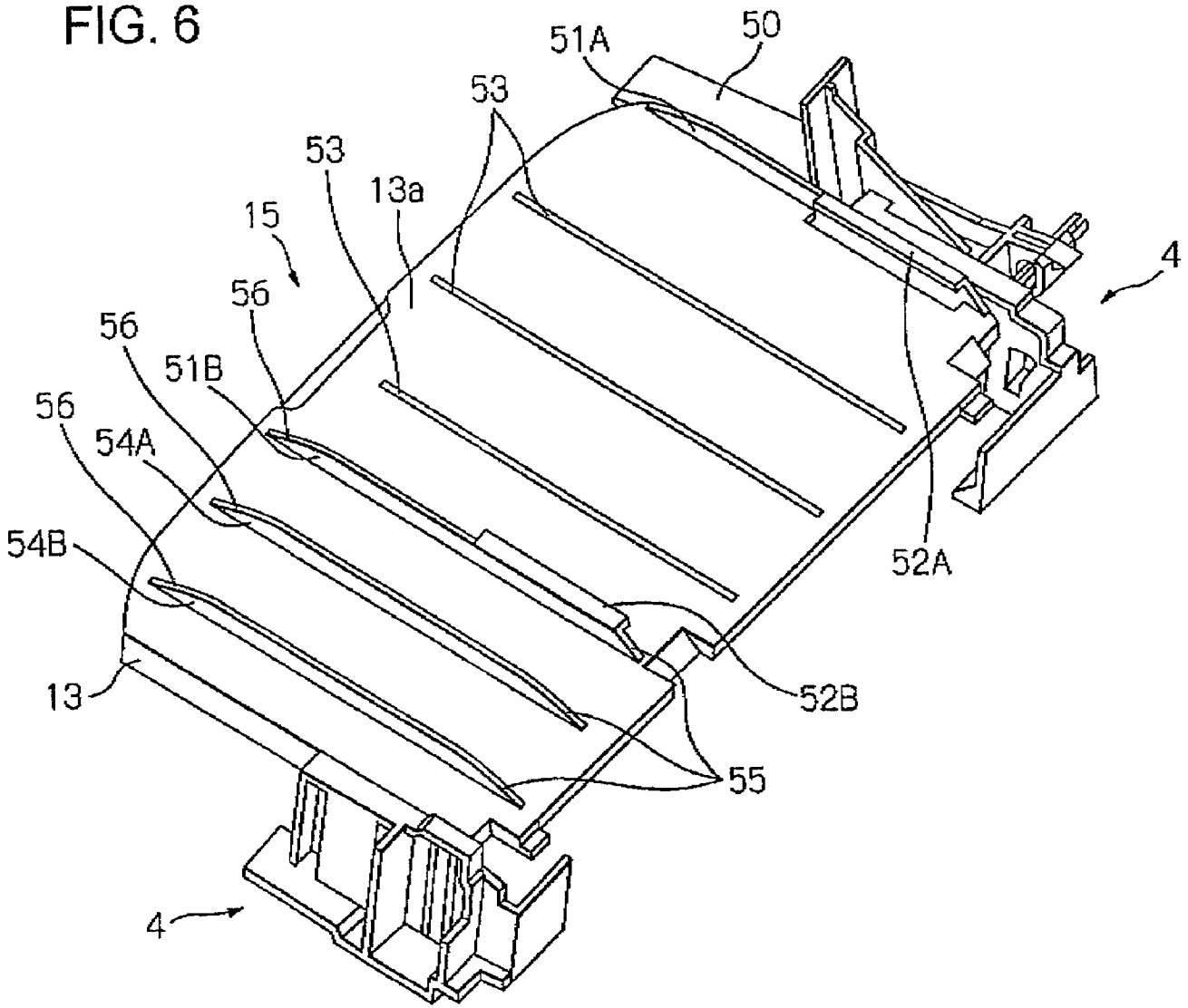
FIG. 6 is a perspective view of the stacker according to the embodiment of the invention.
Figure 7:
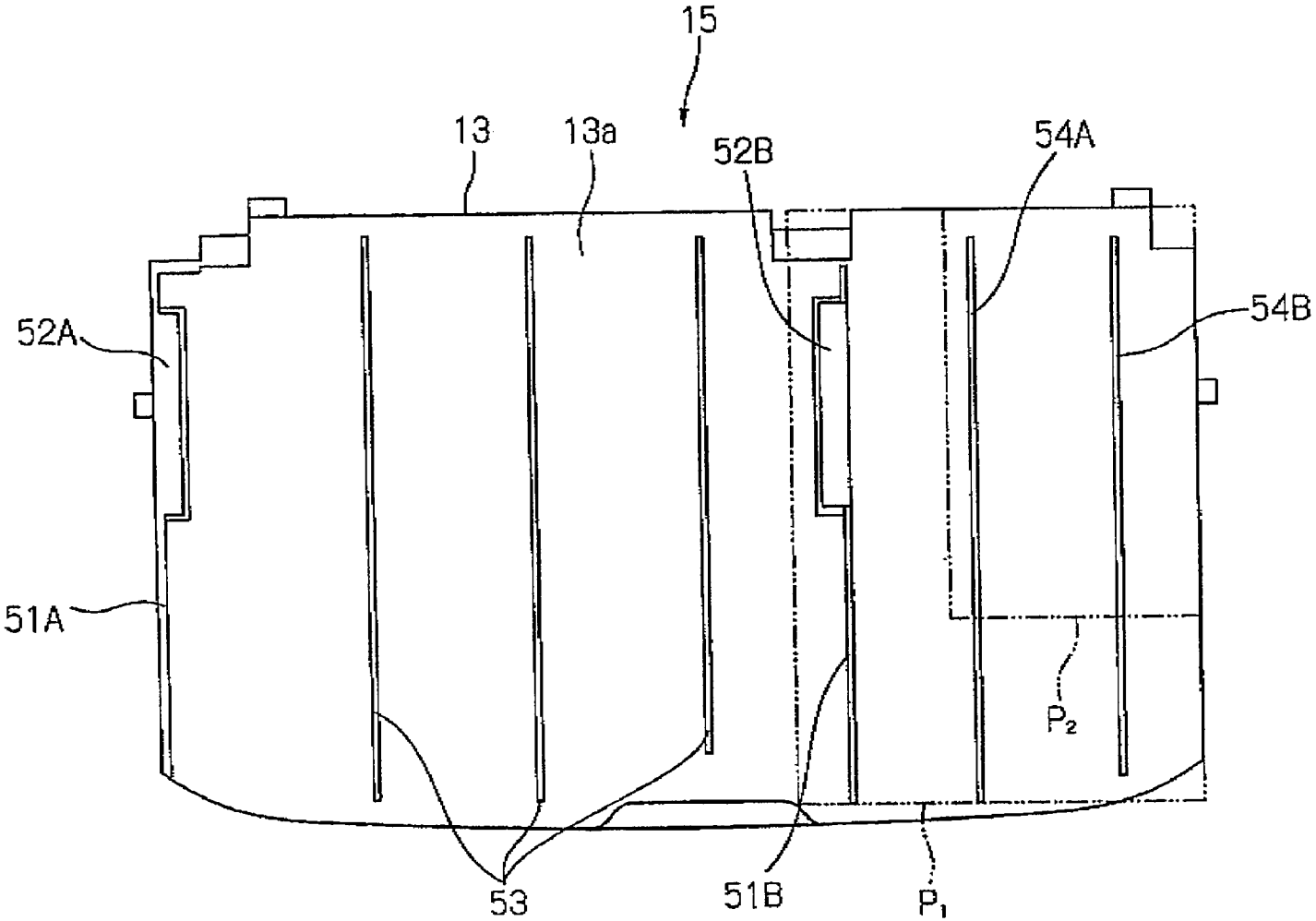
FIG. 7 is a plan view of the stacker according to the embodiment of the invention.
Figure 8:
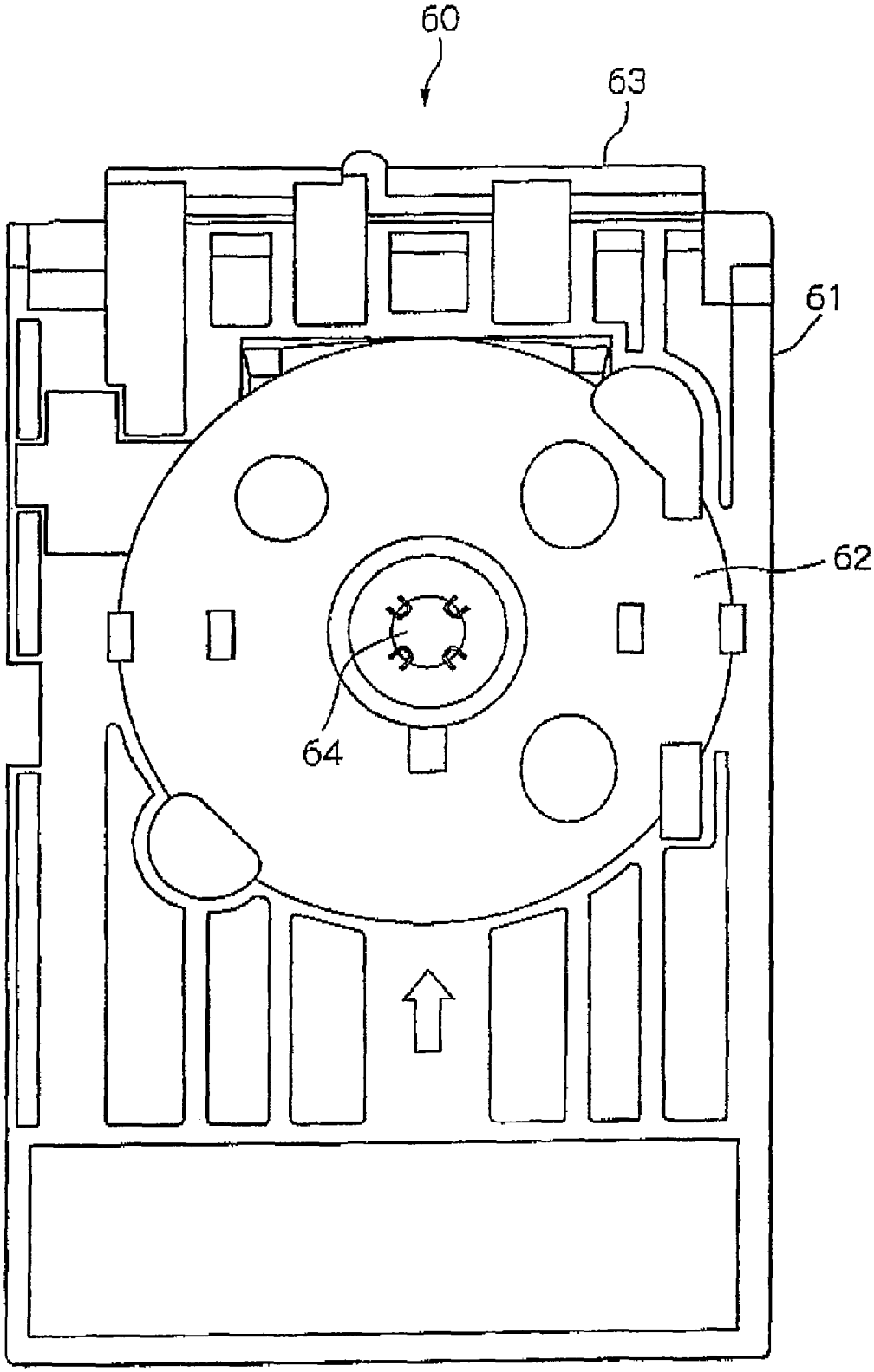
FIG. 8 is a plan view of a tray.

Hereinafter, an embodiment of the invention will be described with reference to FIGS. 1 to 8. FIG. 1 is a perspective view showing an appearance of a printer 1, FIG. 2 is a cross-sectional view showing the printer in the same direction, FIG. 3 is a perspective view showing an appearance of a main body of a printer unit 10, FIG. 4 is a perspective view showing an appearance of entire portions of the printer 1, FIGS. 5 and 6 are perspective views of a stacker 15, FIG. 7 is a plan view of the stacker, and FIG. 8 is a plan view of a tray 60. Hereinafter, the right of FIG. 2 (front side of device) is a "downstream side" of a sheet transporting path and the left thereof (rear side of the device) is an "upstream side".

First, referring to FIGS. 1 and 2, an entire configuration of an ink jet printer (hereinafter, referred to as "printer") which is an example of the recording device or the liquid ejecting device related to the invention will be described. As shown in FIG. 1, the printer 1 is a complex machine including a scanner function in addition to a printer function and includes a printer unit 10 and a scanner unit 9 disposed above the printer unit 10.

The printer unit 10 includes an ink jet printer function for performing ink jet record on a record sheet (single sheet of paper: hereinafter, referred to as "sheet P") which is an example of a recording medium or an injected medium. In FIG. 1, a member denoted by reference numeral 11 indicates a cover body for covering an ejecting port for ejecting the recording sheet P and the cover body 11 rotates by approximately 90° forwardly and opens the ejecting port at the time of using the printer function. A manipulation panel 6 is provided at the upper front side of the printer unit 10, and a scanning function of the scanner unit 9, a recording function of the printer unit 10 and a function for recording a scanned image can be manipulated by the manipulation panel 6.

The scanner unit 9 includes a lid body 8 which can be opened or closed by rotating an unillustrated rotation axis (provided at the rear side thereof) upwardly, and a glass mounting surface (not shown) for mounting a printed material to be scanned is provided below the lid body 8. A scanning device (not shown) is provided below the glass mounting surface. The scanner unit 9 rotates on an illustrated rotation axis (provided at the rear side) upwardly such that the upper side of the printer unit 10 is opened, thereby allowing a member (for example, an ink cartridge) of a record unit such as a carriage to be replaced with a new member or be subjected to maintenance.

Hereinafter, the configuration of the printer unit 10 will be described in detail with reference to FIG. 2. The printer unit 10 has a configuration for feeding the sheet P from a feeding unit 2 provided at the rear side of the device to a transporting roller 29 which is a recording medium transporting unit, transporting the sheet P to a recording unit 32 by the transporting roller 29, and ejecting the recording sheet P out of the device by a recording medium ejecting unit 3. The printer unit 10 has a tray 60 (FIG. 14) having a plate shape, in which an optical disc is set as the recording medium, and a linear transporting path for transporting a transported medium having high rigidity, such as a thick board sheet. That is, the printer unit 10 is configured such that the ink jet record is directly performed on the label side of the optical disc or the board sheet.

Hereinafter, the feeding unit 2 will be first described in detail. The feeding unit 2 includes a hopper 19, a feeding roller 20, a retard roller 21, and a rewinding lever 22.

The hopper 19 is formed from a plate-shaped element and constructed to be able to pivot about a pivot center (not shown) provided in an upper part of hopper 11. As a result of the hopper 11 pivoting, the inclined sheet 2 supported on the hopper 11 is brought into press contact with the feeding roller 20 or is separated from the feeding roller 20. The feeding roller 20 has a D shape when viewed in a side view, feeds a uppermost sheet P, which is in contact with an arc portion thereof, to the downstream side, and is controlled such that a planar portion thereof faces the sheet P to prevent a transporting load from being caused when the sheet P is transported by the transporting roller 29 after the sheet P is fed, as shown.

The retard roller 21 can come in contact with the arc portion of the feeding roller 20. When only one sheet P is fed without double-feed the sheet P, the retard roller 21 rotates (in a clockwise direction of FIG. 2) in contact with the sheet P. When a plurality of sheets P exists between the feeding roller 20 and the retard roller 21, since a friction coefficient between the sheets is lower than a friction coefficient between the sheet P and the retard roller 21, the retard roller 21 does not rotate. Accordingly, a subsequent sheet P which is double-feed by the uppermost sheet P to be fed does not advance from the retard roller 21 to the downstream side and thus double-feed is prevented. The rewinding lever 22 is rotatably provided and serves to rewind the subsequent sheet P to be double-feed onto the hopper 19.

A detecting unit (not shown) for detecting passage of the sheet P and a guide roller 26 for forming a feeding position of the sheet P and preventing the sheet P from coming in contact with the feeding roller 20 to reduce a transporting load are provided between the feeding unit 2 and the transporting roller 29.

The transporting roller 29 provided at the downstream side of the feeding device 2 includes a transporting driving roller 30 which rotates by a motor and a transporting driven roller 31 which rotates in contact with the transporting driving roller 30. The transporting driving roller 30 includes an attachment layer which is formed by uniformly dispersing abrasion resistance particles on an outer circumferential surface of a metal axis which extends in a sheet width direction, and the transporting driven roller 31 has an outer circumferential surface which is formed of a low friction material such as elastomer and is provided in an axial direction of the transporting driving roller 30 in plural, as shown in FIG. 3.

In the present embodiment, two transporting driven rollers 31 are rotatably axis-supported at the downstream end of one upper sheet guide 24 and three upper sheet guides 24 are provided in the sheet width direction, as shown in FIG. 3. By axis-supporting an axis 24*a* to a main frame 23, the upper sheet guide 24 is oscillatably provided on the axis 24*a* when laterally viewing the sheet transporting path and biased by a coil spring 25 in a direction for bringing the transporting driven roller 31 into contact with the transporting driving roller 30. The sheet P fed to the transporting roller 29 by the feeding unit 2 or the tray 60 (FIG. 8) or the board sheet inserted from the front side of the device is transported to the recording unit 32 located at the downstream side in a state of being nipped by the transporting driving roller 30 and the transporting driven roller 31, by rotating the transporting driving roller 30.

The recording unit 32 includes an ink jet recording head (hereinafter, referred to as "recording head") 36 and a lower sheet guide 37 which faces the recording head 36. The recording head 36 is provided at a bottom side of a carriage 33 and the carriage 33 is reciprocally driven by an unillustrated driving motor in a main scanning direction while being guided by a carriage guide axis 34 which extends in the main scanning direction. The carriage 33 has a plurality of color ink cartridges (not shown) in a cover 35 and supplies the ink from the ink cartridges to the recording head 36.

In the lower sheet guide 37 for defining a distance between the sheet P and the recording head 36, a rib (not shown) is formed on the surface facing the recording head 36 and a concave portion (not shown) for abandoning the ink is formed. By abandoning the ink which is discharged to a region out of the end of the sheet P, printing is performed without a blank in the end of the sheet P, that is, frameless printing is performed.

Subsequently, a recording medium ejecting unit 3 is provided at the downstream side of the recording head 36. The recording medium ejecting unit 3 includes a guide roller 43, an ejecting roller 40, an ejection frame assembly 45, an upper frame 48, a roller position switching means 5, and the other components unillustrated in FIG. 2.

The guide roller 43 serves to prevent the sheet P from floating from the lower sheet guide 37 and to uniformly hold the distance between the sheet P and the recording head 36. The ejecting roller 40 includes an ejection driving roller 41 which rotates by an unillustrated motor and an ejection driven roller 42 which rotates in contact with the ejection driving roller 41. In the present embodiment, the ejection driving roller 41 is formed of a rubber roller and is provided in plural in an axial direction of a rotating axis.

The ejection driven roller 42 is formed of a teeth-attached roller having a plurality of teeth on the outer circumference thereof, and is provided on the ejection frame assembly 45 in plural to form pairs with the plurality of ejection driving roller 41. By rotating the ejection driving roller 41 in a state of being nipped by the ejection driving roller 41 and the ejection driven roller 42, the sheet P which is recorded by the recording unit 32 is ejected to a stacker 15. By rotating the ejection driving roller 41, the plate-shaped body such as the tray 60 (FIG. 8) or the board sheet is ejected to the downstream side in a pressed state by a pressing roller 44 toward the ejection driving roller 41.

The ejection frame assembly 45 is provided to be displaced (switched) between a contact position in which the ejection driven roller 42 is in contact with the ejection driving roller 41 and a separate position in which the ejection driven roller 42 is separated from the ejection driving roller 41. Reference numeral 5 denotes a roller position switching unit for displacing the ejection frame assembly 45 from the contact position to the separate position.

The roller position switching unit 5 includes a release member 49. When the tray 60 (FIG. 8) is inserted from the stacker 15, the release member 49 rotates in engagement with the tray 60 to displace the ejection frame assembly 45 from the contact position to the separate position and to displace a pressing roller 78 from a non-press position (position which does not press the tray 60) to a press position (position which presses the tray 60 upwardly).

At the downstream side of the ejection frame assembly 45, the stacker 15 is provided. The stacker 15 is provided to be switched to a first position (FIG. 2 and FIG. 4B) for forming a linear transporting path for transporting the plate-shaped body such as the tray 60 or the board sheet and a second position (FIG. 4A) which is positioned below the first position and stacks the sheet P ejected by the ejecting roller 40 by position switching units 4 (FIG. 3).

When the stacker 15 is positioned at the first position, the tray 60 or the board sheet which is the transported medium having the plate shape is manually inserted (fed) from the front side to the rear side (upstream side) of the device while being supported by the stacker 15. That is, the stacker 15 functions as a guide unit for supporting the tray 60.

As shown in FIG. 8, the tray 60 has a rectangular shape when viewed in a plan view, has a plate shape which can be nipped between the transporting driving roller 30 and the transporting driven roller 31, and can be transported in a sub scanning direction by the rotation of the transporting driving roller 30.

More specifically, the tray 60 is integrally formed of a resin material and includes a tray main body 61 and a set portion 62. The set portion 62 includes a concave portion having a circular shape when viewed in a plan view, as shown. A concave portion 64 is formed in the central portion of the set portion 62. When an optical disc is set in the set portion 62, a central hole of the optical disc is fitted into the concave portion 64 and thus the optical disc is positioned in the set portion 62.

A vertical direction of FIG. 8 is a transporting direction of the tray 60. When the tray 60 is inserted (fed) into the linear transporting path through the stacker 15 positioned at the first position, a front end 63 of the tray 60 is inserted into the device.

Subsequently, the stacker 15 will be described in detail with reference to FIGS. 3 to 7.

As shown in FIG. 3, the stacker 15 provided at the front side of the device includes a main stacker 13 and a sub stacker 14. The sub stacker 14 is extracted from the main stacker 13 such that a support surface (stack surface) for supporting the sheet P extends. FIG. 3 shows a state where the stacker 15 is positioned at the second position. When the stacker 15 is positioned at the first position, that is, when the tray 60 or the board sheet is guided, the sub stacker 14 is received in the main stacker 13.

On the support surface 13*a* of the main stacker 13, as shown in FIGS. 3 to 7, guide ribs 51A and 51B for guiding the both side ends of the tray 60 are formed, and, on the guide ribs 51A and 51B, shade portions 52A and 52B having a shape for covering the upper side of the both side ends of the tray 60 are formed. When the tray 60 is inserted from the stacker 15 positioned at the first position into the printer 1, the position of the tray 60 is restricted in the main scanning direction by the guide ribs 51A and 51B and the tray 60 is prevented from floating from the support surface 13*a* by the shade portions 52A and 52B. On the support surface 13*a*, a plurality of ribs 53 which extends in a direction for inserting the tray 60 is formed at an appropriate interval in a width direction of the tray 60, in order to reduce a contact area between the support surface 13*a* and the bottom surface of the tray 60 to smoothly guide the tray 60.

The position switching units 4 are provided at the both sides of the stacker 15 and the manipulation lever 50 is provided in the left position switching unit 4. As shown in FIGS. 3 and 4A, when the stacker 15 is positioned at the second position, the manipulation lever 50 is positioned at a slight upper side. By pushing down the manipulation lever 50, the position switching units 4 operate and thus the stacker 15 is switched (displaced) to the first position as shown in FIG. 4B.

Even when the scanner unit 9 is provided on the printer unit 10 and thus the stacker 15 is hard to be directly manipulated (when the width is narrow), the position of the stacker 15 can be switched by manipulating the manipulation lever 50 and thus position switching is more easily performed compared with direct manipulation of the stacker 15.

In the present embodiment, when the stacker 13 is positioned at the first position (FIG. 4B), the stacker 13 is in a horizontal state, and, when the stacker 13 is positioned at the second position (FIG. 4A), a free end side of the stacker 13 is slightly slanted upwardly.

Next, the guide rib 51B and support ribs 54A and 54B will be described. In FIG. 7, the right end of the stacker 15 is one column, and, as shown by reference numerals $P_1$ and $P_2$, the recording sheet P is ejected in a state of being right-aligned in the stacker 15, regardless of the sheet size. In FIG. 7, reference numeral $P_1$ denotes a sheet having an L-type picture size (89×127 mm) and reference numeral $P_2$ denotes a sheet having a name card size (55×91 mm).

As shown, among the pair of guide ribs 51A and 51B for guiding the tray 60, since the guide rib 51*b* is slightly biased from the central portion of the support surface 13*a* to one column, the guide rib 51B is positioned at a position for supporting the ejected recording sheet P from the bottom when the stacker 15 is positioned at the second position.

The support ribs 54A and 54B are formed between the guide rib 51 and the right end of the stacker 13. Accordingly, the sheet $P_2$ having a small size is supported by two support ribs 54A and 54B from the bottom and the sheet $P_1$ having a large size is supported by three ribs including the guide rib 51B and the support ribs 54A and 54B from the bottom.

The guide rib 51B and the support ribs 54A and 54B are formed such that top surfaces thereof have a substantially same height and substantially support the ejected sheet P in substantially parallel to the support surface 13*a* of the main stacker 13 when supporting the sheet P.

That is, when the ejected sheet P is supported only by the guide rib 51B, the supported sheet P is slanted in, the sheet width direction and thus may be interfered with a subsequent sheet P which will be ejected later. Accordingly, the ejection of the subsequent sheet P or the orderly lamination of the sheets P may be interrupted. The laminated sheets P may obliquely collapse (in the sheet width direction). However, since the support ribs 54A and 54B are formed between the guide rib 51B and the right end of the main stacker 13 and the sheet P is supported by the ribs in substantially parallel to the support surface 13*a* of the main stacker 13, the above-described problems can be prevented.

Since the interval can be formed between the ejected sheet P and the support surface 13*a*, the ejected sheet P can be easily extracted without adhering the ejected sheet P to the support surface 13*a*. In FIG. 7, as indicated by the reference numerals $P_1$ and $P_2$, since the front end of the sheet is not protruded when the sheet having the small size is ejected, the sheet is harder to be extracted when the sheet is adhered to the support surface 13*a*. However, such a problem is not caused.

The "substantially parallel" means that the supported sheet P need not be parallel to the support surface 13*a* and the range thereof is adequately set by those skilled in the art in a range that a subsequent sheet P is not interrupted by the slope of the supported sheet P in the sheet width direction or a range that the laminated sheets P do not collapse in the sheet width direction.

In the present embodiment, the guide rib 51B and the support ribs 54A and 54B extend over the ejection direction of the sheet P on the support surface 13*a* of the stacker 13 and thus the sheet P ejected on the main stacker 13 can be more surely supported in parallel to the support surface 13*a*.

Since the upstream ends of the guide rib 51B and the support ribs 54A and 543 have slope surfaces 55, the front end of the ejected sheet P can be smoothly ejected without being caught by the ribs. Since the downstream ends of the guide rib 51B and the support ribs 54A and 54B have slope surfaces 56, when the sub stacker 14 is extracted from the main stacker 13 and sheets P having a large longitudinal size are stacked, the sheets P can be reasonably stacked in a natural position, without forming a step by the downstream ends of the ribs.

A rib having a large height is not formed between the guide rib 51B and the guide rib 51A. However, since the sheet P which has a large width and of which the side ends are positioned between the guide rib 51B and the guide 51A has high flexibility in the sheet width direction and is slowly curved to follow the support surface 13*a*, this sheet P is hardly interfered with the subsequent sheet P and the laminated sheets P hardly collapse in the sheet width direction.

As indicated by the reference numerals $P_1$ and $P_2$ of FIG. 7, the sheet having a small width has low flexibility in the sheet width direction and is stack on the guide rib 51A to be supported in a slanted state. By providing the support ribs 51A and 51B for supporting the sheet having a small size, it is possible to prevent the ejection of a subsequent sheet P from being interrupted due to interference with the subsequent sheet P, to prevent the orderly lamination of the sheets P from being interrupted, or to prevent the laminated sheets from obliquely collapsing (in the sheet width direction). Since the sheet is not adhered to the support surface 13*a*, the stacked sheet can be easily extracted.

What is claimed is:

1. A stacker in a transporting device including a linear transporting path for transporting a first transport medium, wherein the stacker is disposed at a downstream side of an ejecting unit for ejecting a second transport medium, and can be switched between a first position that forms the linear transporting path and a second position which is positioned below the first position where the second transport medium ejected by the ejecting unit may be stacked, wherein the stacker includes a pair of guide ribs which support the first transport medium and guide both sides of the first transport medium as the first transport medium is transported into the linear transporting path when the stacker is in the first position, wherein the stacker further includes one of support ribs disposed at a position for supporting the bottom of the ejected second transport medium when the stacker is in the second position, wherein at least one of the guide ribs which support the first transport medium also acts as a support rib for supporting the bottom of the ejected second transport medium when the stacker is in the second position, and wherein the guide ribs and support ribs are formed so that the second transport medium ejected to the stacker is level when supported by the guide ribs and the support ribs when the stacker is in the second position.

2. The stacker according to claim 1, wherein the guide rib and the support rib extend over an ejection direction of the second transport medium on the support surface.

3. The stacker according to claim 1, wherein upstream ends of the guide rib and the support rib have oblique surfaces.

4. The stacker according to claim 1, wherein downstream ends of the guide rib and the support rib have oblique surfaces.

5. A recording device including a linear transporting path for transporting a plate-shaped body, comprising:

a stacker is disposed at a downstream side of an ejecting unit for ejecting a recording medium, and can be switched between a first position that forms the linear transporting path and a second position which is positioned below the first position where the recording medium ejected by the ejecting unit may be stacked, wherein the stacker includes a pair of guide ribs which support the recording medium and guide both sides of the recording medium as the recording medium is transported into the linear transporting path when the stacker is in the first position, wherein the stacker further includes one pair of support ribs disposed at a position for supporting the bottom of the ejected recording medium when the stacker is in the second position, wherein at least one of the guide ribs which support the first transport medium also acts as a support rib for supporting the bottom of the ejected recording medium when the stacker is in second position, and wherein the guide ribs and support ribs are formed so that the recording medium ejected to the main stacker is level when supported by the guide ribs and the support ribs when the stacker is in the second position.

6. A liquid ejecting device including a linear transporting path for transporting a first target medium, the liquid ejecting device comprising:

a stacker disposed at a downstream side of an ejecting unit for ejecting a second target medium, the stacker capable of being switched between a first position that forms the linear transporting path and a second position which is positioned below the first position where the second target medium ejected by the ejecting unit may be stacked, wherein the stacker includes a pair of guide ribs which support the first target medium and guide both sides of the first target medium as the first target medium is transported into the linear transporting path when the stacker is in the first position, wherein the stacker further includes one of support ribs disposed at a position for supporting the bottom of the ejected second target medium when the stacker is in the second position, wherein at least one of the guide ribs which support the first target medium also acts as a support rib for supporting the bottom of the ejected second target medium when the stacker is in the second position, and wherein the guide ribs and support ribs are formed so that the second target medium ejected to the main stacker is level when supported by the guide ribs and the support ribs when the stacker is in the second position.

* * * * *

UNITED STATES PATENT AND TRADEMARK OFFICE

CERTIFICATE OF CORRECTION

PATENT NO. : 7,651,087 B2
APPLICATION NO. : 11/465425
DATED : January 26, 2010
INVENTOR(S) : Miyashita et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 685 days.

Signed and Sealed this

Twenty-third Day of November, 2010

David J. Kappos

David J. Kappos
*Director of the United States Patent and Trademark Office*